US005901502A

United States Patent [19]

Rafalski et al.

[11] Patent Number: 5,901,502

[45] Date of Patent: May 11, 1999

[54] DUCT ACCESS DOOR FOR CIRCULAR OPENINGS

[75] Inventors: Edward F. Rafalski, North Huntington; Alan Shuey, Monongahela, both of Pa.

[73] Assignee: Ductmate Industries, Inc., E. Monongahela, Pa.

[21] Appl. No.: 08/897,204

[22] Filed: Jul. 21, 1997

[51] Int. Cl.[6] ..... E06B 3/32

[52] U.S. Cl. ..... 49/463; 49/466

[58] Field of Search ..... 49/463, 465, 466

[56] References Cited

U.S. PATENT DOCUMENTS 4,970,836 11/1990 Brown ..... 49/465 X 5,165,189 11/1992 Besal ..... 49/466 X 5,669,190 9/1997 Szyjkowski ..... 49/465 X

FOREIGN PATENT DOCUMENTS 340158 9/1921 Germany ..... 49/466

*Primary Examiner*—Jerry Redman

*Attorney, Agent, or Firm*—George Raynovich, Jr., Esq.

[57] ABSTRACT

A duct access door to close and seal a circular opening in an HVAC duct is provided. The access door includes an outer cover which completely covers the circular hole and has a gasket for sealing against the duct. An inner panel fits within the circular hole and threaded fastener bias the outer cover towards the inner panel to seal the circular hole in the duct. Insulation may be provided between the outer cover and the inner panel of the access door if desired.

10 Claims, 4 Drawing Sheets

DUCT ACCESS DOOR FOR CIRCULAR OPENINGS

BACKGROUND OF THE INVENTION

1. Field of the Invention

This invention relates to a Duct Access Door for sealingly closing a circular access hole formed in an air duct so that access to the interior of the duct can be gained as desired.

2. Description of the Prior Art

In modern heating, ventilating and air conditioning (HVAC) systems, sheet metal duct work is utilized to convey conditioned air throughout buildings. Conventionally, access holes are formed in the duct work at various locations for various purposes. The access holes may provide access to clean the interior of the duct work or to inspect turning vanes, fire dampers or other hardware inside the duct. Existing clamping type access doors are rectangular or oval in shape. Prior to this invention round holes were closed with simple patches that do not allow easy access later or more complicated doors which are more expensive.

Duct access doors in the prior art have been formed from sheet metal having an outer panel and an inner panel that are connected by bolts or other means of biasing them toward each other. A gasket is provided around the periphery of the access door. Because of the rectangular or oval shape of the prior art duct access parts, the inner panel of the door may be inserted into the duct while the outer panel of the door remains outside the duct. The two panels are then tightened together to clamp the duct wall between them so that the gasket engages the duct wall and one of the panels to seal the duct access port.

SUMMARY OF THE INVENTION

The duct cleaning industry has a need for a clamping type access door which will close a round hole in a duct. The duct cleaning technician utilizes a vacuum hose which is round. It is obviously helpful to utilize the round hose with a round access port in the duct. In addition, duct cleaning technicians are typically not skilled in the art of sheet metal work. Cutters are available which make round holes quickly and easily in established duct work. Square, rectangular or oval-shaped holes require the ability to use aviation or tin snips which require specialized skills.

There are currently available clamping type access doors which will close rectangularly-shaped holes. These doors use the same size panel for the inside and outside of the duct. The door panels are actually larger than the hole they are covering. They are installable because the diagonal dimension of the hole is greater than the longest dimension of the door. This solution does not hold true for the round access port.

In accordance with the present invention, there is provided a duct access door for sealingly closing a circular opening of a given diameter in an air duct. The access door includes an outer circular cover of a second diameter larger than the given diameter of the circular opening. An annular gasket having an inside diameter larger than the given diameter is secured to the circular cover. A generally circular inner panel with the circular portion having a diameter the size of the second diameter has two parallel diametrically opposed flat sides formed on the circular inner panel so that the straight line distance between the flat sides through the center of the generally circular inner panel is smaller than the given diameter. Biasing means operable to connect the outer circular cover to the inner panel and to bias the outer circular cover and the inner panel toward each other are provided whereby when the inner panel is inserted into the duct through the circular opening, the outer circular cover is positioned outside the duct, and the biasing means is operated to bias the outer circular cover and the inner panel toward each other, the outer circular cover covers the duct circular opening and the gasket seals the outer circular cover to the duct.

Accordingly, an object of the present invention is to provide an easily operable duct access door to sealingly close a circular access port in a duct.

Another object of the present invention is to provide an access door for sealing a circular port in the sheet metal duct of a construction that the access door may be insulated if the duct is insulated.

These and other objects of the present invention will be more completely disclosed and described in the following specification, the accompanying drawings and the appended claims.

DESCRIPTION OF THE PREFERRED EMBODIMENT

Figure 1:
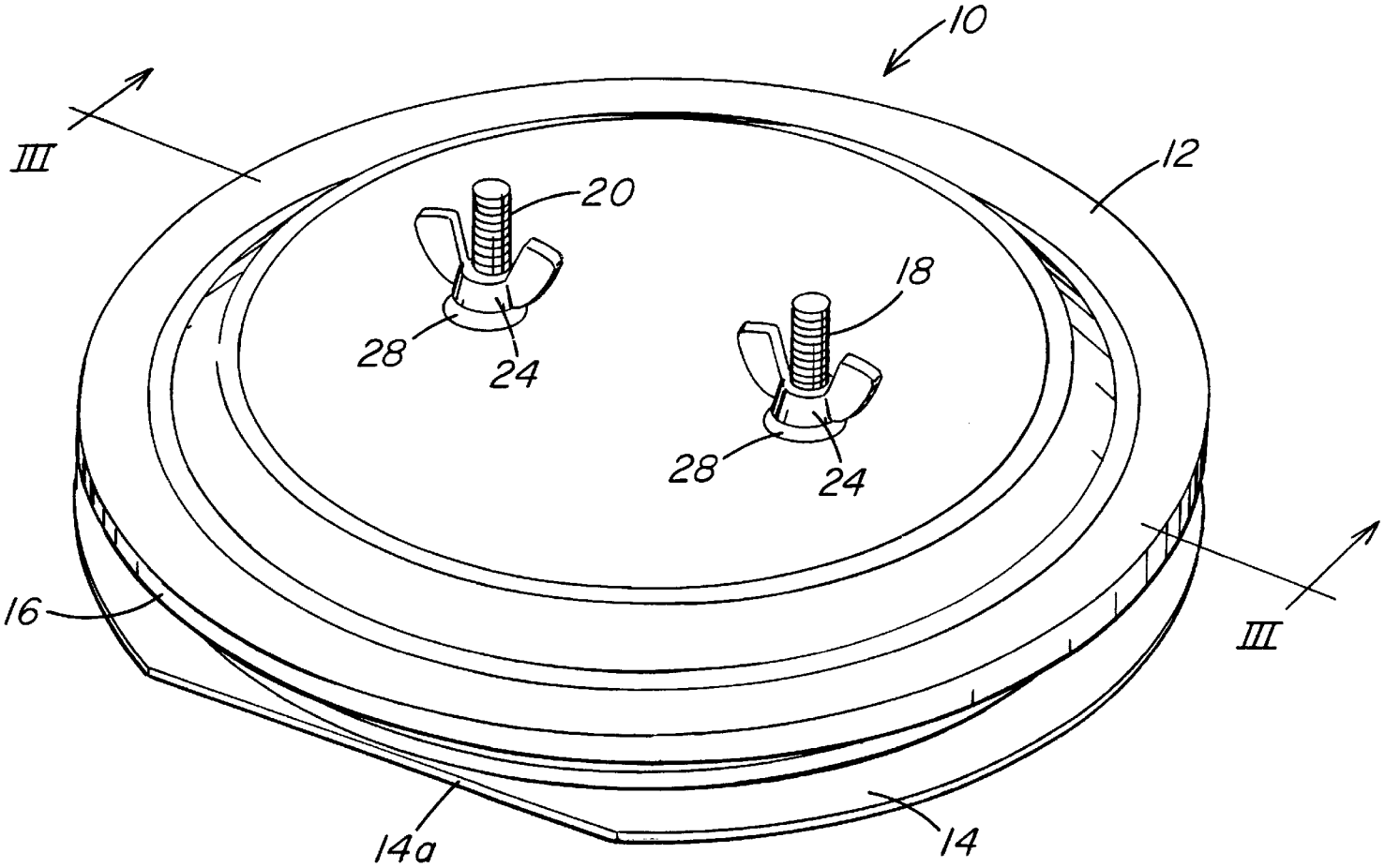
FIG. 1 is a perspective view of the Duct Access Door of the present invention in an assembled condition.

Referring to the drawings, there is shown a duct access door 10 having an outer circular cover 12 and an inner panel 14. An annular gasket 16 is affixed to the underside of the duct access door 10.

A threaded member 18 and a threaded member 20 are secured to the inner panel 14 and project upwardly from the inner panel 14 through mating holes 22 formed in the outer cover 12. Inner panel 14 may alternately be formed with square holes so that carriage bolts may be inserted into them as a substitute for threaded members 18 and 20. Wing nuts 24 are threaded onto the threaded members 18 and 20 to bias the circular outer cover 12 toward the inner panel 14.

Figure 3:
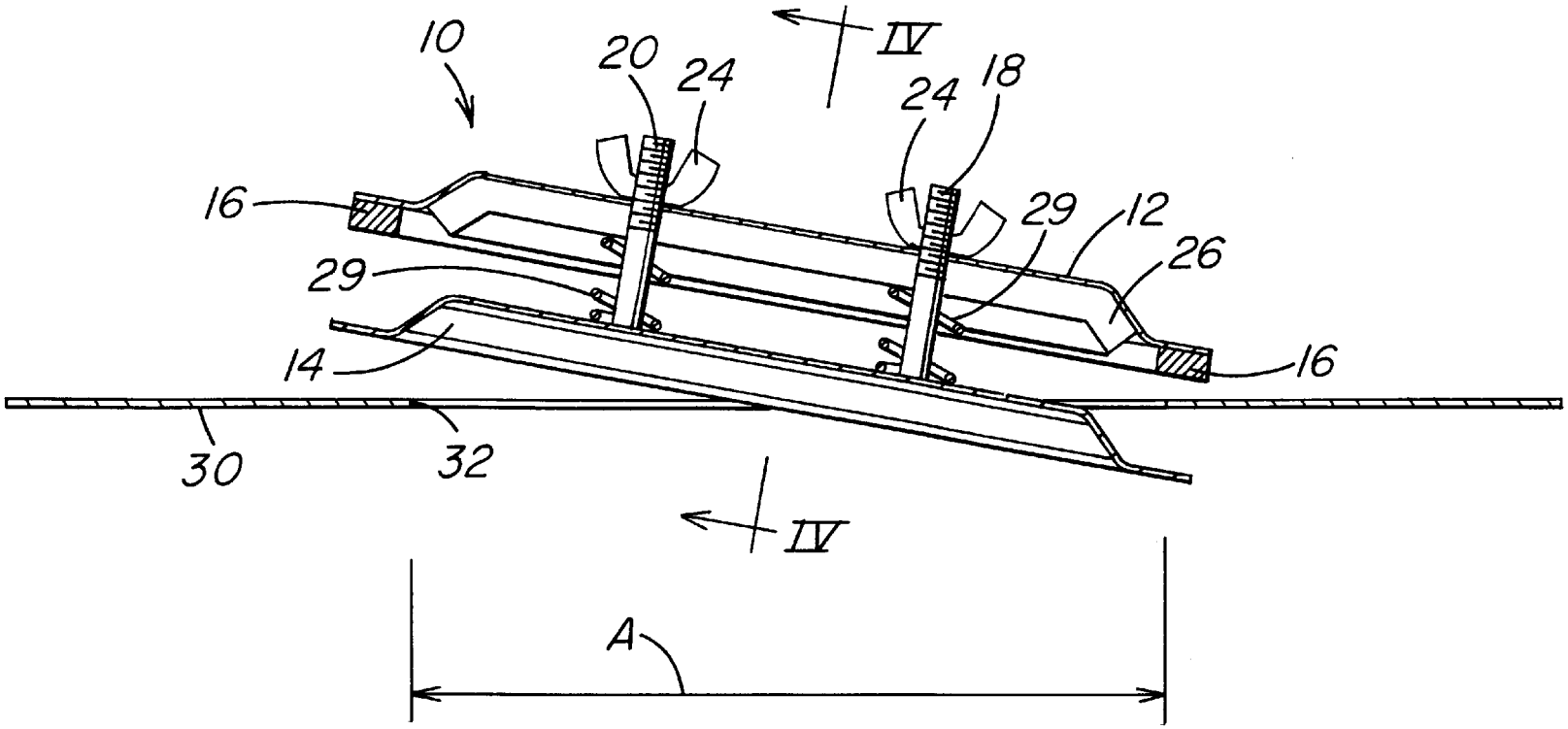
FIG. 3 is a sectional view taken along line III—III of FIG. 1 with the access door partially inserted into a circular opening in a sheet metal duct.
Figure 4:
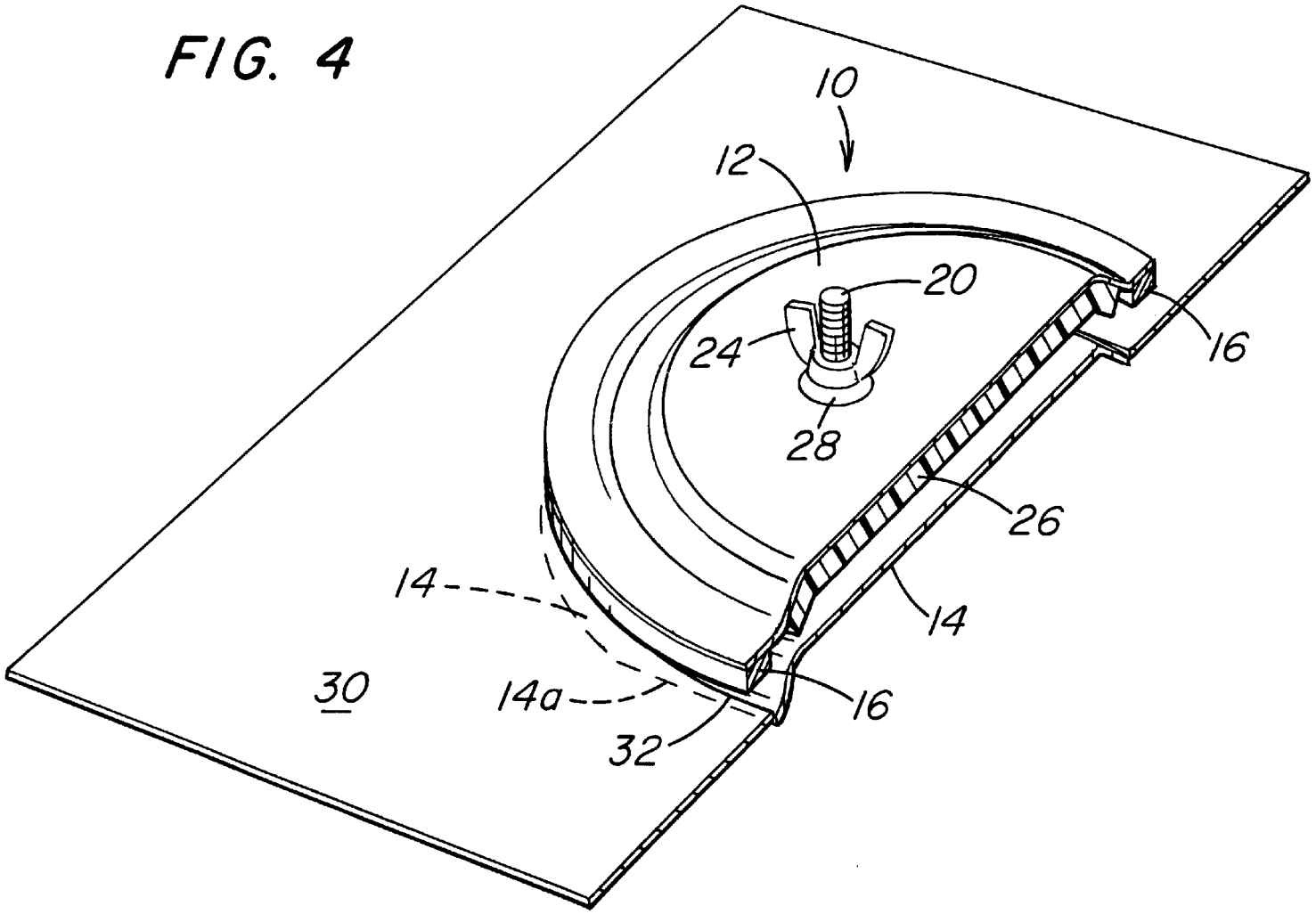
FIG. 4 is a perspective sectional view taken along line IV—IV of FIG. 3.

If desired, insulation 26 may be positioned between the outer cover 12 and the inner panel 14. Washers 28 may be positioned over threaded members 18 and 20 below wing nuts 24 to prevent leakage around the threaded members 18 and 20. As shown in FIG. 3, coil springs 29 are positioned over threaded members 18 and 20 and between the outer cover 12 and the inner panel 14 to hold outer cover 12 and inner panel 14 apart while the access door 10 is being positioned within duct 30.

Figure 2:
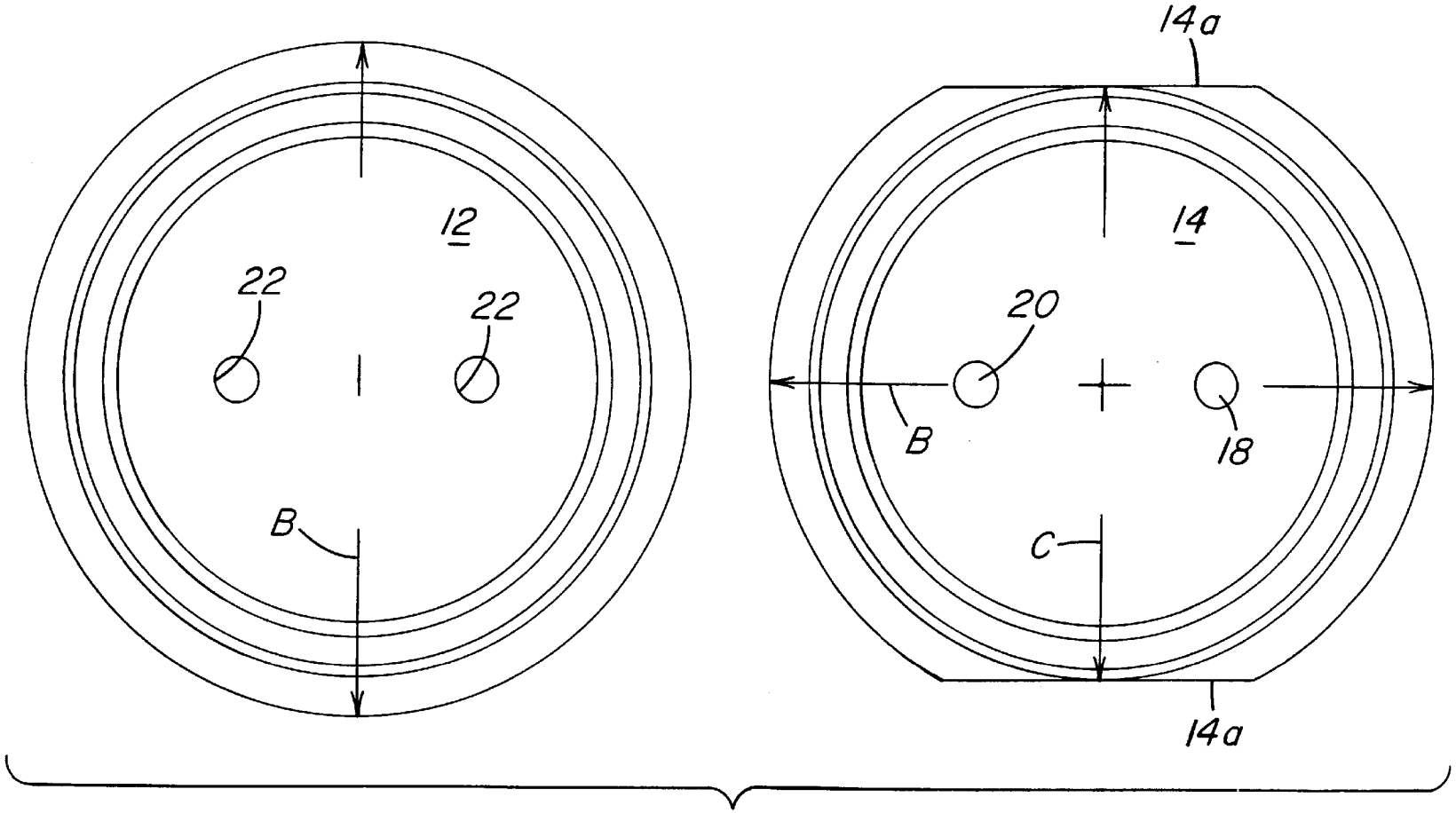
FIG. 2 is a top plan view of the outer cover and a top plan view of the inner panel of the duct access door of the present invention in side by side relationship.

As shown in FIG. 3, the duct access door 10 is being inserted into a circular hole 32 formed within a duct 30. The circular hole 32 has a diameter indicated at A. As seen in FIG. 2, the outer circular cover 12 has a diameter B which is larger than the diameter A of hole 32. The inner panel 14 is generally circular and the circular portions of the inner panel 14 have the same diameter B as the diameter of the outer cover 12. Formed on the inner panel 14 are two diametrically opposed parallel flat portions 14*a* such that the distance through the center of the inner panel 14 between the two parallel flat portions 14*a* is indicated at C. The distance C is less than the diameter A of the circular hole 32 to be closed by the duct access door.

As may be seen in FIG. 3, the access door 10 is positioned so that the inner panel 14 goes into the interior of the duct while the circular outer cover 12 remains outside the duct. Because of the flat portions 14*a* on the inner panel 14, the inner panel may be inserted into the hole 32 while the circular outer cover 12, having a diameter larger than the diameter of the hole 32 remains outside the duct 30. After the duct access door 10 is positioned with the circular outer cover 12 covering the hole, the wing nuts 24 are tightened to bias the outer cover 12 toward the inner panel 14 against the force of coil springs 29 which causes the gasket 16 around the outer cover 12 to sealingly contact the duct 30.

The outer cover 12 and the inner cover 14 are ordinarily formed of galvanized sheet metal, although other appropriate material may be utilized. As indicated, the minimum dimension C of the inner panel 14 is smaller than the diameter A of the circular hole 32 formed within the duct 30. The minimum dimension B of the outer cover 12 and the circular portions of inner panel 14 is larger than the diameter A of the circular hole 32. With this arrangement, the inner panel 14 may be inserted into the duct through hole 32 while the outer cover 12 remains outside the duct.

According to the provisions of the patent statutes, we have explained the principle, preferred construction and mode of operation of our invention and have illustrated and described what we now consider to represent its best embodiment. However, it should be understood that, within the scope of the appended claims, the invention may be practiced otherwise than as specifically illustrated and described.

We claim:

1. A duct access door comprising:

an outer cover having an outer surface and an inner surface with a minimum dimension larger than a given diameter of a circular opening in a duct that said access door closes and seals;

a gasket secured to the said outer cover inner surface around the periphery of said outer cover;

an inner panel having a maximum dimension greater than said given diameter of said circular opening and a minimum dimension smaller than said given diameter;

a plurality of biasing means operable to non-rotatably connect said outer cover to said inner panel and to bias said outer cover and said inner panel toward each other whereby when said inner panel is inserted into said duct through said circular opening, said outer cover is positioned outside said duct, and said biasing means is operated to bias said outer cover and said inner panel toward each other, said outer cover covers said duct circular opening and said gasket seals said outer cover to said duct.

2. The duct access door of claim 1 wherein said plurality of biasing means are threaded fasteners.

3. The duct access door of claim 1 wherein said plurality of biasing means includes two threaded members fixed to said inner panel that project through holes formed in said outer cover and receive threaded nuts positioned outside said outer cover.

4. The duct access door of claim 1 wherein insulation is secured between said outer cover and said inner panel.

5. The duct access door of claim 1 wherein said outer cover and said inner panel are formed of galvanized sheet metal.

6. A duct access door comprising:

an outer circular cover having a diameter larger than a given diameter of a circular opening in a duct that said access door closes and seals;

an annular gasket having an inner diameter larger than said given diameter secured to said circular cover;

a generally circular inner panel whose circular portion has a diameter the size of said outer circular cover diameter and has two parallel diametrically opposed flat sides formed on said circular inner panel so that the straight line distance between said flat sides through the center of said circular inner panel is smaller than said given diameter;

biasing means operable to connect said outer circular cover to said inner panel and to bias said outer circular cover and said inner panel toward each other whereby when said inner panel is inserted into said duct through said circular opening, said outer circular cover is positioned outside said duct, and said biasing means is operated to bias said outer circular cover and said inner panel toward each other, said outer circular cover covers said duct circular opening and said gasket seals said outer circular cover to said duct.

7. The duct access door of claim 6 wherein said biasing means is a threaded fastener.

8. The duct access door of claim 6 wherein said biasing means includes two threaded members fixed to said inner panel that project through holes formed in said outer circular cover and receive threaded nuts positioned outside said outer cover.

9. The duct access door of claim 6 wherein insulation is secured between said outer circular cover and said inner panel.

10. The duct access door of claim 6 wherein said outer circular cover and said inner panel are formed of galvanized sheet metal.

* * * * *